US006259190B1

(12) United States Patent
Pierrejean

(10) Patent No.: US 6,259,190 B1
(45) Date of Patent: Jul. 10, 2001

(54) MICROPOINT TYPE COLD CATHODE

(75) Inventor: Didier Pierrejean, Villaz (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/112,322

(22) Filed: Jul. 9, 1998

(30) Foreign Application Priority Data

Jul. 10, 1997 (FR) ..... 97 08793

(51) Int. Cl.[7] ..... H01J 1/02; H01J 1/16; H01J 19/10; H01J 1/62

(52) U.S. Cl. ..... 313/309; 313/336; 313/351; 313/495; 313/308

(58) Field of Search ..... 313/307, 308, 313/309, 310, 336, 351, 495; 445/24, 50–51, 46, 49; 204/221; 438/20

(56) References Cited

U.S. PATENT DOCUMENTS

| | | | | |
|---|---|---|---|---|
| 5,389,026 | * | 2/1995 | Fukuta et al. | 445/24 |
| 5,557,160 | * | 9/1996 | Makishima et al. | 313/336 |
| 5,663,608 | * | 9/1997 | Jones et al. | 313/309 |
| 5,734,223 | * | 3/1998 | Makishima et al. | 313/495 |
| 5,825,122 | * | 10/1998 | Givargizov et al. | 313/336 |
| 5,990,612 | * | 11/1999 | Konuma | 313/495 |
| 6,043,103 | * | 3/2000 | Takemura | 438/20 |

FOREIGN PATENT DOCUMENTS

| | | |
|---|---|---|
| WO9209095 | 5/1992 | (WO) . |
| WO9624152 | 8/1996 | (WO) . |

OTHER PUBLICATIONS

Patent Abstracts of Japan. vol. 095; No. 004, May 31, 1995 corresponding to JP 07 029484 A (Futaba Corp) Jan. 31, 1995.

C. A. Spindt et al. "Physical Properties of Thin–Film Field Emission Cathodes with Molybdenum Cones", Dec. 1, 1976, Journal of Applied Physics, vol. 47, Nr. 12, pp. 5248–5263 XP000560520.

* cited by examiner

*Primary Examiner*—Ashok Patel
*Assistant Examiner*—Mack Haynes
(74) *Attorney, Agent, or Firm*—Sughrue, Mion, Zinn, Macpeak & Seas, PLLC

(57) ABSTRACT

A micropoint type cold cathode comprises a substrate including an array of micropoints and a plate disposed parallel to the substrate carrying the points. The plate includes a hole facing each point and thereby constitutes a grid. An insulator fills the space between the substrate and the grid except at the location of the points. The nominal distance between the summit of a point and the face of the grid farthest from the substrate is zero, the nominal radius of curvature at the summit of each point is 25 nm and the nominal radius of the holes in the grid is 1.3 $\mu$m.

1 Claim, 2 Drawing Sheets

MICROPOINT TYPE COLD CATHODE

BACKGROUND OF THE INVENTION

1. Field of the Invention

The present invention concerns a micropoint type cold cathode.

In particular, the invention applies to mass spectrometers in which the heated electrical filament emitting electrons is replaced by a micropoint type cold cathode. Cold cathodes of this type are electron emitting devices manufactured using semiconductor processes.

2. Description of the Prior Art

Unfortunately cold cathodes of the above type offer poor performance, only around 10% of the points of an array of micropoints emitting electrons. This is due to the non-homogeneous nature of the array of points which is caused, among other things, by manufacturing tolerances.

Because the points are non-homogeneous, the electric field at the end of a point varies greatly from one point to another. Electron emission as a function of the electric field at the end of the point obeys an exponential law. The resulting non-homogeneous emission is disadvantageous and the disadvantage is increased for operation at "high pressure", for example at a pressure equal to or greater than $10^{-4}$ mbar. If one point emits more electrons than its neighbors it is more sensitive to the phenomena of positive ion return and arcing which damage the points.

An aim of the present invention is therefore to propose a micropoint type cold cathode which improves the homogeneity of electron emission from the micropoints.

SUMMARY OF THE INVENTION

The invention therefore consists of a micropoint type cold cathode comprising a substrate including an array of micropoints and a plate disposed parallel to the substrate carrying the points, the plate including a hole facing each point and thereby constituting a grid, an insulator filling the space between the substrate and the grid except at the location of the points, wherein the nominal distance between the summit of a point and the face of the grid farthest from the substrate is zero, the nominal radius of curvature at the summit of each point is 25 nm and the nominal radius of the holes in the grid is 1.3 $\mu$m.

Experiments show that some parameters are very important in the geometry of a cold cathode, in particular the following parameters: the distance d between the summit of a point and the face of the grid farthest from the substrate, the radius of curvature RT at the summit of the point and the radius $R_{GH}$ Of the holes in the grid facing each point.

A nominal value has been found for these three parameters for which the total drift of the field value at the ends of the points relative to the three parameters d, $R_T$ and $R_{GH}$ is minimal and therefore corresponds to a value of the field at the end of the points having minimal dispersion.

These conditions yield an optimized array, i.e. an array for which the electric field at the end of the points varies only slightly, within the manufacturing tolerances, around the nominal value of these parameters. These nominal values are as follows: d=0, $R_T$=25 nm and $R_{GH}$=1.3 $\mu$m.

The result is that an array is obtained having a high number of points that emit in the same fashion, three or four times greater than in a non-optimized array.

DETAILED DESCRIPTION OF THE PREFERRED EMBODIMENT

Figure 1:
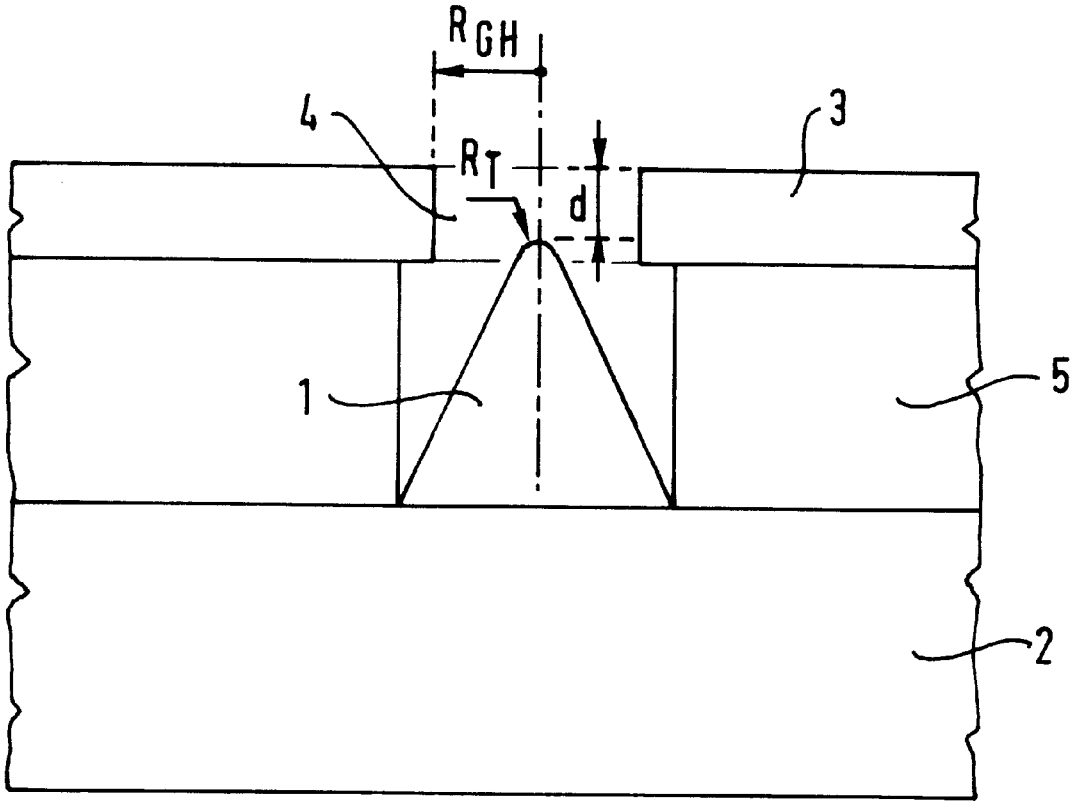
FIG. 1 is a diagrammatic view of part of a micropoint type cold cathode in accordance with the invention.

FIG. 1 shows a portion of a cold cathode and represents only one point. The points like the point 1 are formed on a substrate 2. A plate 3 known as the grid and having a hole 4 of radius RGH facing each point is disposed parallel to the substrate 2. An insulator 5 fills the space between the substrate 2 and the grid 3 except at the locations of the points.

In accordance with the invention, the nominal value of $R_{GH}$ is 1.3 $\mu$m with a tolerance corresponding to the manufacturing tolerance of±0.2 $\mu$m; the nominal value of the radius of curvature $R_T$ at the summit of each point 1 is $R_T$=25 nm, the manufacturing tolerance being±5 nm; and the nominal value of the distance d between the summit of a point 1 and the face of the grid 3 farthest from the substrate 2 is d=0, the manufacturing tolerance being±0.5 $\mu$m.

Figure 2:
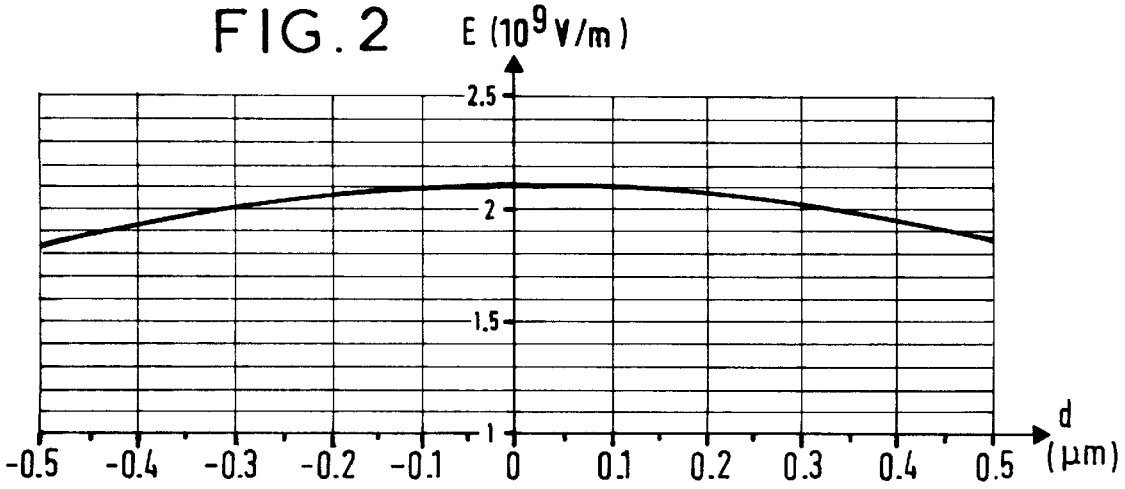
FIGS. 2, 3 and 4 are graphs of the value of the field at the end of the points as a function of the value of the parameters d, $R_T$ and $R_{GH}$, respectively.

FIG. 2 shows the value of the field E in units of $10^9$ v/m as a function of d.

Figure 3:
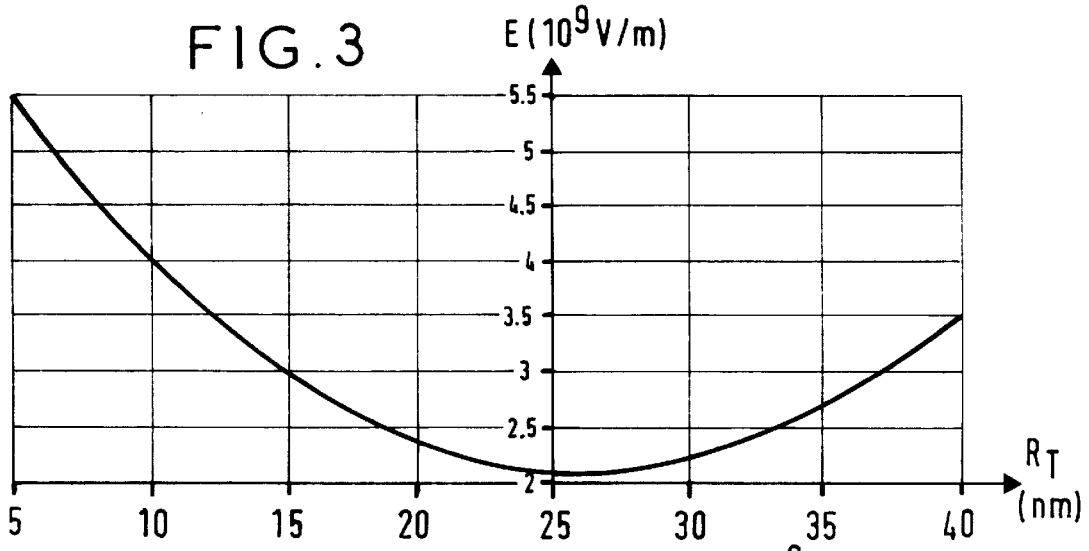
Figure 4:
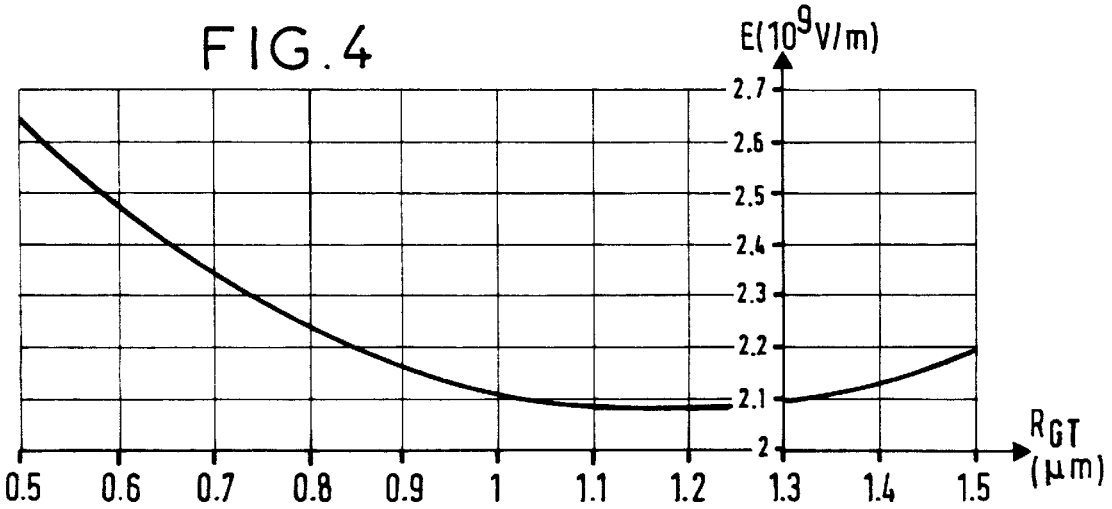

FIG. 3 shows the value of the field as a function of $R_T$ and FIG. 4 shows the value of the field as a function of $R_{GH}$.

Calculations show that the total drift of the field relative to these three parameters is minimal for these values d=0, $R_T$=25 nm and $R_{GH}$=1.3 $\mu$m.

What is claimed is:

1. A micropoint type cold cathode comprising a substrate including an array of micropoints and a plate disposed parallel to said substrate carrying said points, said plate including a hole facing each point and thereby constituting a grid, an insulator filling the space between said substrate and said grid except at the location of said points, wherein the nominal distance between the summit of a point and the face of said grid farthest from said substrate is zero, the nominal radius of curvature at the summit of each point is 25 nm and the nominal radius of said holes in said grid is 1.3 $\mu$m.

* * * * *